US007717810B2

(12) United States Patent
Watanabe et al.

(10) Patent No.: US 7,717,810 B2
(45) Date of Patent: May 18, 2010

(54) GOLF BALL

(75) Inventors: Hideo Watanabe, Chichibu (JP); Takashi Ohira, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 190 days.

(21) Appl. No.: 11/180,683

(22) Filed: Jul. 14, 2005

(65) Prior Publication Data

US 2007/0015603 A1 Jan. 18, 2007

(51) Int. Cl.
*A63B 37/06* (2006.01)

(52) U.S. Cl. ..... 473/378

(58) Field of Classification Search ..... 473/351, 473/378

See application file for complete search history.

(56) References Cited

U.S. PATENT DOCUMENTS 4,802,674 A * 2/1989 Kitaoh ..... 473/373
5,542,680 A * 8/1996 Proudfit et al. ..... 473/378
5,800,287 A * 9/1998 Yokota et al. ..... 473/372
6,096,851 A * 8/2000 Maruoka et al. ..... 528/85
6,129,640 A * 10/2000 Higuchi et al. ..... 473/374
6,949,595 B2 * 9/2005 Morgan et al. ..... 524/102
2004/0106478 A1 * 6/2004 Hayashi et al. ..... 473/378

FOREIGN PATENT DOCUMENTS

JP 8-229162 A 9/1996

OTHER PUBLICATIONS

Material Data Sheets for Surlyns 8527, 9910, and 9520.*

* cited by examiner

*Primary Examiner*—Raeann Trimiew
(74) *Attorney, Agent, or Firm*—Sughrue Mion, PLLC

(57) ABSTRACT

A golf ball composed of a solid core of at least one layer and a cover of at least one layer is characterized in that the solid core or an inner cover layer adjacent to an outer cover layer has a light-reflecting pigment-containing coating applied to a surface thereof and at least the outer cover layer is transparent or translucent and has a surface that is marked with lettering or a design. The ball has a metallic texture, in addition to which the marks such as lettering or a design appear three-dimensional, giving the ball a high-quality feel.

17 Claims, 1 Drawing Sheet

GOLF BALL

BACKGROUND OF THE INVENTION

The present invention relates primarily to a golf ball of improved appearance, which ball has a metallic texture and also bears markings, such as lettering or a design, that appear three-dimensional, giving the ball a high-quality feel.

In the technical field relating to golf balls, various innovations are commonly made to improve ball performance, including carry, feel, controllability and durability. Over the past few years, in addition to such ball performance characteristics, there has been a growing demand for novelty of appearance, attractiveness, and a sense of quality. It has thus become important recently to finish the golf ball so as to make the appearance at the ball's surface, particularly markings such as lettering and designs, more attractive and thus impart a sense of quality, and also to maintain this appearance to some degree even after the ball has been hit.

Such golf balls have been disclosed in, for example, JP-A 8-229162 (and the corresponding U.S. Pat. No. 5,542,680). This prior-art golf ball has a core with markings formed thereon, which core is enclosed within a transparent cover.

Although this golf ball is indeed novel, the markings do not have a three-dimensional effect and the ball lacks a metallic texture and a high-quality feel. As such, the aesthetic appearance of the ball leaves much room for improvement.

U.S. Pat. No. 5,427,378 discloses a golf ball whose surface is coated with a brightly reflecting material, but this differs from a golf ball having a sense of quality centered on the three-dimensional display of markings. Moreover, the forces incurred by the ball when it is struck with a golf club may cause the brightly reflecting material to peel off, damaging the appearance of the ball.

It is therefore an object of the invention to provide a golf ball endowed with a metallic texture and also having markings such as lettering or a design that appear three-dimensional, thus giving it a high-quality feel.

SUMMARY OF THE INVENTION

As a result of extensive investigations, we have discovered that, in a golf ball composed of a solid core and a cover, by applying a metal powder pigment-containing coating to the surface of the solid core, enclosing the coated core within a substantially transparent cover, and marking the cover with lettering or a design, the use of the metal powder pigment imparts a metallic texture and the marks such as lettering or a design can be made to appear three-dimensional under the effect of the transparent cover. These synergistic effects impart the golf ball with a sense of quality.

Accordingly, the invention provides the following golf ball.

[1] A golf ball composed of a solid core of at least one layer and a cover of at least one layer, which golf ball is characterized in that the solid core or an inner cover layer adjacent to an outer cover layer has a light-reflecting pigment-containing coating applied to a surface thereof and at least the outer cover layer is transparent or translucent and has a surface that is marked with lettering or a design.

[2] The golf ball of [1] above, wherein the light-reflecting pigment is at least one selected from the group consisting of metal powder pigments, glass flakes, mica and pearlescent pigments.

[3] The golf ball of [1] or [2] above, wherein the metal powder pigment is at least one selected from the group consisting of aluminum powder, bronze powder, stainless steel powder and nickel powder.

[4] The golf ball of [4] above, wherein the light-reflecting pigment is mica or glass flake which is surface-coated with titanium oxide or iron oxide.

[5] The golf ball of [1] above, wherein the light-reflecting pigment is a metal powder pigment composed of aluminum powder.

[6] The golf ball of [1] above, wherein the coating applied to the surface of the solid core or the inner cover layer adjacent to the outer cover layer is a thermoset coating.

[7] The golf ball of [1] above, wherein the solid core has a diameter of 38.9 to 40.3 mm and the cover has a thickness of 1.2 to 1.9 mm.

[8] The golf ball of [1] above, wherein the solid core has a deflection when subjected to loading from an initial load state of 98 N (10 kgf) to a final load of 1,275 N (130 kgf) of 2.5 to 5.0 mm, and the cover has a Shore D hardness of at least 50 but not more than 70.

[9] The golf ball of [1] above, wherein the solid core is made of a base material comprising a mixture of 100 parts by weight of cis-1,4-polybutadiene and 1 to 20 parts by weight of styrene-butadiene rubber.

[10] The golf ball of [1] above, wherein the coating has a color difference before and after application to the surface of the solid core or the inner cover layer adjacent to the outer cover layer, expressed in the Lab color system, of at most 20.

BRIEF DESCRIPTION OF THE DIAGRAMS

DETAILED DESCRIPTION OF THE INVENTION

Figure 1:
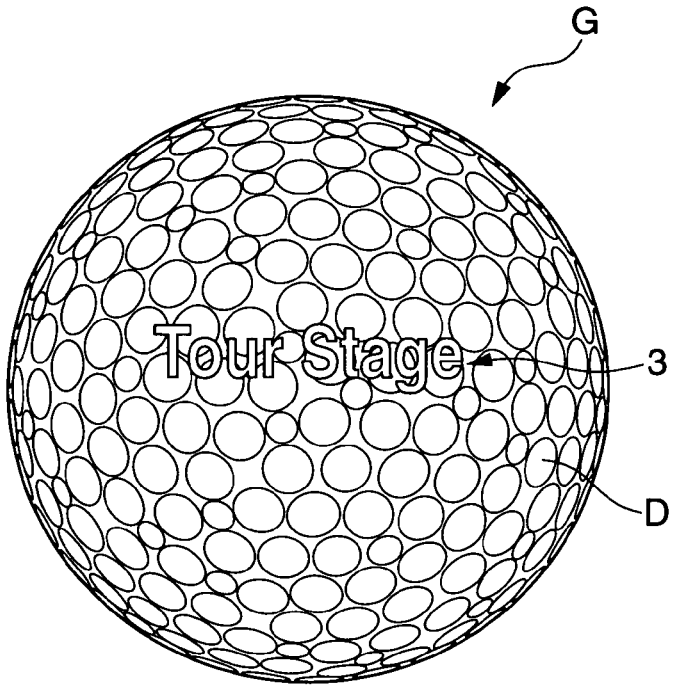
FIG. 1 is a plan view of a golf ball according to one embodiment of the invention.

The invention is described more fully below.

The golf ball of the invention is composed of a solid core of at least one layer and a cover of at least one layer.

The solid core can be formed using a known rubber material as the base material. A known base rubber such as natural rubber or a synthetic rubber may be employed. More specifically, the use of primarily polybutadiene, particularly 1,4-cis polybutadiene having a cis structure of at least 40%, is recommended. If desired, the base rubber may also be composed of, together with the foregoing polybutadiene, another rubber such as natural rubber, polyisoprene rubber or styrene-butadiene rubber.

To manufacture the golf ball at a low cost and keep the rebound performance of the ball within the range set forth in the Royal and Ancient Golf Club of St. Andrews (R&A) rules, it is desirable to mix 1 to 30 parts by weight, preferably 2 to 20 parts by weight, and more preferably 4 to 10 parts by weight, of styrene-butadiene rubber per 100 parts by weight of polybutadiene rubber.

The polybutadiene can be synthesized using a metal catalyst such as a rare-earth catalyst (e.g., a neodymium catalyst), a cobalt catalyst or a nickel catalyst.

The base rubber can have mixed therein other components, including a co-crosslinking agent, examples of which include unsaturated carboxylic acids and their metal salts; an organic filler such as zinc oxide, barium sulfate or calcium carbonate; and an organic peroxide such as dicumyl peroxide or 1,1-bis (t-butylperoxy)cyclohexane. If necessary, other components such as a commercial antioxidant may be suitably added as well.

The solid core can be formed as a single layer or as a two-layer structure having an outer layer. When a solid core having a two-layer structure is formed, the outer layer may be made of the same type of rubber material as the center core or a different type of rubber material.

The solid core has a diameter of generally at least 38.9 mm, preferably at least 39.0 mm, and more preferably at least 39.2 mm, but not more than 40.3 mm, preferably not more than 40.0 mm, and even more preferably not more than 39.8 mm. If the solid core has too small a diameter, the cover will be relatively thick, which may diminish the cover transparency and lower the brightness, or luster, of the ball. On the other hand, if the solid core has too large a diameter, the cover will be relatively thin, which may lower the durability of the ball when repeatedly hit with a golf club.

The deflection hardness of the solid core is described. The solid core has a deflection when subjected to loading from an initial load state of 98 N (10 kgf) to a final load of 1,275 N (130 kgf) of generally 2.5 to 5.0 mm, preferably 3.0 to 4.0 mm, and more preferably 3.2 to 3.6 mm. If the deflection is too small, the "feel" of the ball when hit with a golf club may be too hard or the speed at which the ball separates from the face of the club may be so rapid as to compromise the controllability of the ball. Too large a deflection may give the ball too soft a feel on impact, lower the durability of the ball to cracking with repeated impact, and lower the rebound so that a good carry is not achieved.

The solid core has a surface hardness, expressed as the Shore D hardness, of generally at least 36, preferably at least 46, and more preferably at least 50, but generally not more than 62, preferably not more than 57, and even more preferably not more than 55.

The solid core has a center hardness, expressed as the Shore D hardness, of generally at least 32, preferably at least 37, and more preferably at least 38, but generally not more than 43, preferably not more than 41, and more preferably not more than 40. If both the surface and center of the solid core are too hard, the feel of the ball may become too hard and the speed at which the ball separates from the club face may be excessive. On the other hand, if these hardness values are both too small, the feel on impact may become softer than desirable, the durability to cracking on repeated impact may decline, and the rebound may decrease, shortening the carry of the ball.

In the practice of the invention, a light-reflecting pigment-containing coating is applied to a surface of the solid core or a surface of the inner cover layer adjacent to the outer cover layer. The coating applied to the surface of the solid core or the inner cover layer (collectively referred to below as the "spherical object") must be capable of withstanding large deformation, even though the surface of the spherical object will not be directly hit with a golf club. For this reason, the same two-part curing urethane coating may be used. The two-art curing urethane coating is composed of a polyol component having hydroxyl groups and a polyisocyanate component having isocyanate groups.

Examples of polyols that may be used include primarily urethanes, polyesters and acrylic resins, although other resins, including epoxy resins, can be used if necessary. Examples of polyisocyanates that may be used include tolylene diisocyanate (TDI), diphenylmethane-4,4'-diisocyanate (MDI), hexamethylene diisocyanate (HDI), isophorone diisocyanate (IPDI), naphthalene diisocyanate (NDI), 1,4-phenylene diisocyanate (PDI), xylylene diisocyanate (XDI) and hydrogenated xylylene diisocyanate (HXDI), either singly or in modified forms as combinations thereof. The polyisocyanate can generally be in the form of an adduct, a biuret or an isocyanurate.

The coating is composed of the above-described resin as the base, to which any of various solvents and additives may be suitably added. In the present invention, the coating additionally includes a light-reflecting pigment. The light-reflecting pigment is added in an amount, based on the coating solids, of generally 2 to 50 wt %, preferably 5 to 30 wt %, and more preferably 15 to 25 wt %. If the amount of light-reflecting pigment added is lower than the foregoing range, the ball may have insufficient luster, compromising the effects of the invention. On the other hand, if too much light-reflecting pigment is added, the ease of coating application may dramatically decline, the rebound of the ball may decrease, and separation of the solid core and the cover tends to arise. As a result, the durability of the ball to repeated impact may decrease.

The applied coat of the above coating has a thickness of generally at least 2 μm, preferably at least 3 μm, and more preferably at least 4 μm, but not more than 30 μm, preferably not more than 20 μm, and more preferably not more than 10 μm. If the applied coat is too thin, the color of the solid core may be visible through the coat following application, which may result in an unsatisfactory metallic texture. Conversely, if the applied coat is too thick, the rebound of the ball may decrease, shortening the carry, in addition to which separation of the core and the cover tends to arise. As a result, the durability of the ball to repeated impact may decrease.

Any of various light-reflecting pigments may be used, although preferred light-reflecting pigments include metal powder pigments, glass flakes, mica and pearlescent pigments. Specific examples of these metal powder pigments include aluminum powder, bronze powder, stainless steel powder and nickel powder. Of these, aluminum powder is preferred because, when used together with a color pigment or dye, the color tone is easily adjusted. Examples of such aluminum pigments that may be used include the commercial products available under the trade names Aluminum Paste Hiprint TD200T and Metasheen Slurry KM100 (both manufactured by Toyo Aluminum K.K.). Pearlescent pigments are broadly divided into metal oxide-coated micas, basic lead carbonate, bismuth oxychloride and natural pearl essence. Of these, the selection of a metal oxide-coated mica is preferred because such pigments are nontoxic and have the best chemical stability. Titanium dioxide or iron oxide is typically used as the metal oxide; by varying the coverage (thickness of the coating layer), various colors and interference effects can be achieved. The larger the particle size of these pigments, the greater the degree of luster that can be achieved. However, at a larger pigment particle size, the luster has a tendency to readily subside. Hence, it is necessary to select a pigment having a suitable particle size within a range that does not compromise the objects and advantages of the invention.

The appearance of the inventive golf ball after the coating has been applied is preferably such that the ball has a metallic texture and exhibits a silver color which is nearly white when seen from a distance.

The coating has a color difference before and after application to the surface of the solid core, expressed in the Lab color system, of at most 20, preferably at most 15, and more preferably at most 10. At too high a color difference, should the core be marred by support pins during injection molding of the cover and the applied coat peel off as a result, the affected spots will be conspicuous, which may compromise the appearance of the ball.

In the inventive golf ball, of the cover, at least an outer cover layer is transparent or translucent. Markings such as lettering or a design are made in the surface of this cover layer.

The primary material of the cover is not subject to any particular limitation. For example, a known thermoplastic resin, preferably an ionomer resin, can be suitably selected. If necessary, any of various elastomers and additives may be added to the cover main material, provided the transparency is not thereby compromised. For example, adding titanium oxide has an adverse effect on the transparency of the cover as a whole, making it impossible to achieve a silver-metallic appearance. Hence, titanium oxide cannot be used in the invention.

The cover has a Shore D hardness of generally at least 50, preferably at least 57, and even more preferably at least 60, but generally not more than 70, preferably not more than 68, and even more preferably not more than 65. If the cover has a Shore D hardness greater than the above range, the durability of the golf ball to repeated impact may decrease and the feel of the ball on impact may be too hard. Conversely, if the cover has a Shore D hardness that is too low, the ball may have a smaller rebound and may take on greater spin, shortening the carry.

The cover has a thickness of generally at least 1.2 mm, preferably at least 1.35 mm, and more preferably at least 1.45 mm, but generally not more than 1.9 mm, preferably not more than 1.85 mm, and more preferably not more than 1.75 mm. A cover thickness greater than the above range may result in a diminished cover transparency, lowering the luster of the ball. Conversely, if the cover is too thin, the ball may have a lower durability to repeated impact.

Numerous dimples may be formed on the surface of the cover. To achieve a good carry, the number of dimples is generally 250 to 500, preferably 300 to 450, and more preferably 330 to 440. Marks such as lettering or a design are applied to this cover surface, and the marked area is given a three-dimensional feel by the metallic coated area of the solid core surface in combination with the transparent cover. In the practice of the invention, such marks are not applied to the surface of the solid core.

The marks such as lettering or a design can be formed by directly or indirectly printing letters, numbers, trade names and patterns such as logos on the surface of the ball. Suitable techniques for making such marks include stamp printing, pad printing, transfer-tape printing, inkjet printing, and printing with an electrostatic copier.

In the present invention, any of various coatings can additionally be applied to the surface of the golf ball cover. Given the need to withstand the demanding conditions of golf ball use, preferred examples include two-part curing urethane coatings, particularly non-yellowing urethane coatings. When the golf ball is given a metallic texture by including a metallic pigment in the coating, a three-dimensional effect cannot be imparted to the marks on the surface of the ball. Moreover, if the surface of the ball is marred, the underlying layer becomes visible, in addition to which the marks applied to the surface of the cover become impossible to see, compromising the effects of the invention. For these reasons, a metallic pigment is not included in the coating applied to the surface of the cover. Any of various known coating methods may be used to apply the coating to the surface of the golf ball cover, including spray coating, electrostatic coating and dip coating. Of these, spray coating is preferred because there is no need for relatively large equipment and a uniform coat can easily be applied. Any of these methods for applying a coating to the surface of the golf ball cover can also be used to apply a coating to the surface of the spherical object, such as the core.

The golf ball of the invention, so long as it is a golf ball having a solid core of at least one layer which is enclosed with one or more cover layer, may be in any of various forms, including two-piece solid golf balls and multi-piece solid golf balls which are composed of three or more pieces and include on the outside a cover formed of at least two layers. When the golf ball of the invention is a multi-piece golf ball having two or more cover layers on the outside, the light-reflecting pigment-containing coating may be applied to the surface of the solid core or to the surface of the inside cover layer which encloses the solid core.

The golf ball of the invention can be made in accordance with the Rules of Golf for use in competitive play, in which case the ball may be formed to a diameter of not less than 42.67 mm and a weight of not more than 45.93 g. It is recommended that the upper limit for the diameter be generally not more than 44.0 mm, preferably not more than 43.5 mm, and more preferably not more than 43.0 mm, and that the lower limit for the weight be generally not less than 44.5 g, preferably not less than 45.0 g, more preferably not less than 45.1 g, and even more preferably not less than 45.2 g.

In the golf ball of the invention, by applying to the surface of the solid core a metallic pigment-containing coating, there can be imparted a metallic texture. In addition, by means of the transparent or translucent cover, marks such as lettering or a design on the cover of the ball can be given a three-dimensional effect. These effects work together to give the golf ball a distinctive sense of quality.

EXAMPLES

Examples of the invention and comparative examples are given below by way of illustration and not by way of limitation.

Examples 1 and 2, Comparative Examples 1 to 3

Rubber compositions having the properties shown in Table 1 below were formulated, mixed using a kneader or roll mill, then manufactured into a solid core under specific vulcanizing conditions.

TABLE 1

| | | Example | | Comparative Example | | |
|---|---|---|---|---|---|---|
| | | 1 | 2 | 1 | 2 | 3 |
| Core formulation | Butadiene rubber[1)] | 92 | 92 | 92 | 92 | 92 |
| | Styrene-butadiene rubber[2)] | 8 | 8 | 8 | 8 | 8 |
| | Zinc acrylate | 24.5 | 24.5 | 24.5 | 24.5 | 24.5 |

TABLE 1-continued

| | Example | | Comparative Example | | |
|---|---|---|---|---|---|
| | 1 | 2 | 1 | 2 | 3 |
| Peroxide (1)[3] | 0.6 | 0.6 | 0.6 | 0.6 | 0.6 |
| Peroxide (2)[4] | 0.6 | 0.6 | 0.6 | 0.6 | 0.6 |
| Antioxidant[5] | 0.1 | 0.1 | 0.1 | 0.1 | 0.1 |
| Zinc oxide | 5 | 5 | 5 | 5 | 5 |
| Barium sulfate | 17.3 | 17.3 | 17.3 | 17.3 | 17.3 |
| Vulcanization method (temperature, time) | 155° C., 15 min | 155° C., 15 min | 155° C., 15 min | 155° C., 15 min | 155° C., 15 min |

Amounts of components in the table are given in parts by weight.

Trade names for materials mentioned in the table are given below.

[1]Produced by JSR Corporation under the trade name BR01.

[2]Produced by JSR Corporation under the trade name SBR1507.

[3]Peroxide (1) is dicumyl peroxide produced by NOF Corporation under the trade name Percumil D.

[4]Peroxide (2) is 1,1-bis(t-butylperoxy)-3,3,5-trimethylcyclohexane produced by NOF Corporation under the trade name Perhexa 3M-40.

[5]Produced by Ouchi Shinko Chemical Industry Co., Ltd. under the trade name Nocrac NS-6.

Next, the base coating shown in Table 2 was applied onto the solid core. Physical properties of the solid core (prior to application of the base coating) are also shown in Table 2.

TABLE 2

| | | Example | | Comparative Example | | |
|---|---|---|---|---|---|---|
| | | 1 | 2 | 1 | 2 | 3 |
| Applied to core | Base coating | Non-yellowing urethane resin coating | Non-yellowing urethane resin coating | None | None | Non-yellowing urethane resin coating |
| | Aluminum pigment added | Aluminum Paste Hiprint[6] | Metasheen Slurry KM100[7] | — | — | Aluminum Paste Hiprint[6] |
| | Amount of addition (wt %) (w/r base coating, exclusive of thinner) | 20 | 20 | — | — | 20 |
| | Coat thickness (μm) | 5 | 5 | — | — | 5 |
| Core diameter (mm) | | 39.3 | 39.3 | 39.3 | 39.3 | 39.3 |
| Weight (g) | | 36.9 | 36.9 | 36.9 | 36.9 | 36.9 |
| Deflection hardness, 10-130 kgf (mm) | | 3.4 | 3.4 | 3.4 | 3.4 | 3.4 |
| Core surface (Shore D hardness) | | 52 | 52 | 52 | 52 | 52 |
| Core center (Shore D hardness) | | 39 | 39 | 39 | 39 | 39 |

Trade names for materials mentioned in the table are given below.

[6]An aluminum pigment produced by Toyo Aluminum K.K. under the trade name Aluminum Paste Hiprint TD200T (ingredients: aluminum, 68-71 wt %; oleic acid, ≧1 wt %; mineral spirits, ≧3 wt %; toluene, 25 to 30 wt % or less)

[7]An aluminum pigment produced by Toyo Aluminum K.K. under the trade name Metasheen Slurry KM100 (ingredients: aluminum, 10 wt %; ethyl acetate, 45 wt %; isopropyl acetate, 45 wt %)

Figure 2:
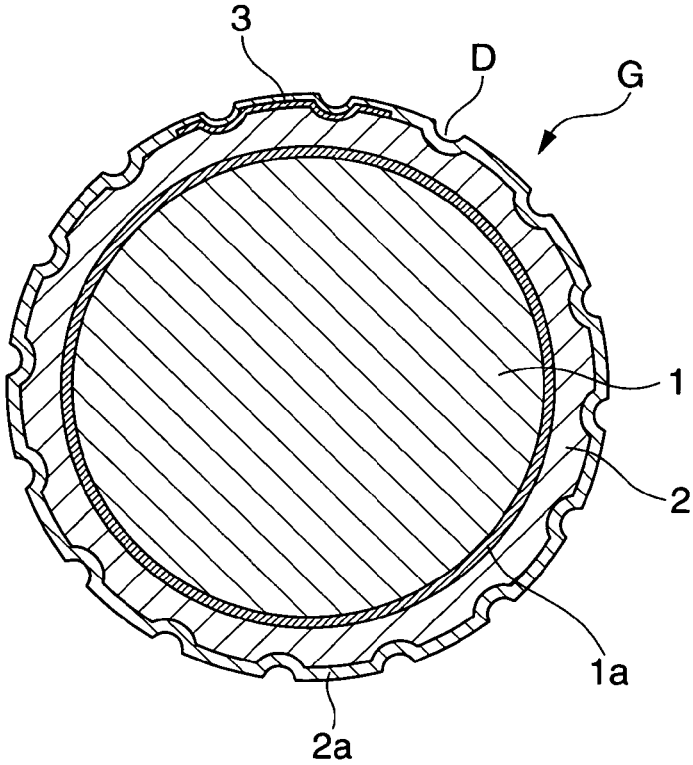
FIG. 2 is a cross-sectional view of the internal structure (two-layer structure) of the golf ball in FIG. 1.

Next, a one-layer cover was injection molded over the surface of the solid core, and specified markings were made on the cover surface. As shown in Table 3 below, a base coating such as a non-yellowing urethane resin coating was applied to the surface of the ball. Referring to FIGS. 1 and 2, the golf balls in Examples 1 and 2 were golf balls G composed of a solid core 1 having on the surface thereof a coat 1*a* formed by the application of a coating. A one-layer cover 2 was formed over the coat 1*a*, and markings 3 were made at a predetermined position on the surface of the cover 2. In addition, a coat 2*a* formed from a clear coating was applied over the entire surface of the ball.

The physical properties and appearance of the balls obtained in Examples 1 and 2 of the invention and in the comparative examples were measured or rated. The results are shown in Table 3 below.

TABLE 3

| | | Example | | Comparative Example | | |
|---|---|---|---|---|---|---|
| | | 1 | 2 | 1 | 2 | 3 |
| Cover | Cover composition (pbw) | | | | | |
| | Himilan 1706 | 50.0 | 50.0 | 50.0 | 50.0 | 50.0 |
| | Himilan 1605 | 50.0 | 50.0 | 50.0 | 50.0 | 50.0 |
| | Titanium oxide | — | — | 5 | 5 | — |
| | Cover color | Transparent | Transparent | White | White | Transparent |
| | Shore D hardness | 63 | 63 | 63 | 63 | 63 |
| | Thickness (mm) | 1.7 | 1.7 | 1.7 | 1.7 | 1.7 |
| Marking site | | A | A | A | A | B |
| Application to surface of ball | Base coating | Non-yellowing urethane resin coating | Non-yellowing urethane resin coating | Non-yellowing urethane resin coating | Non-yellowing urethane resin coating | Non-yellowing urethane resin coating |
| | Aluminum pigment added | — | — | Aluminum Paste Hiprint[6)] | — | — |
| | Amount of addition, wt % (w/r base coating, exclusive of thinner) | — | — | 20 | — | — |
| | Coat thickness (μm) | 20 | 20 | 20 | 20 | 20 |
| Ball | Diameter (mm) | 42.7 | 42.7 | 42.7 | 42.7 | 42.7 |
| | Weight (g) | 45.3 | 45.3 | 45.4 | 45.4 | 45.3 |
| | Deflection hardness, 10-130 kgf (mm) | 2.9 | 2.9 | 2.9 | 2.9 | 2.9 |
| | Initial velocity (m/s) | 77.3 | 77.3 | 77.3 | 77.3 | 77.3 |
| Appearance | Silver metallic feel | good | good | good | NG | good |
| | 3D feel of marking | good | good | NG | NG | NG |
| | Appearance when surface of ball was marred | good | good | NG | good | good |

Note:
Marking site A in the table, as shown in FIG. 2, is a position located between the surface of the cover and the coat applied to the surface of the ball. Marking site B has been laminated directly onto the coat on the surface of the solid core, and is situated inside the cover.

Deflection Hardness

The deflection hardness was measured as the amount of deflection (mm) by the ball when it was subjected to an increase in load from an initial load state of 98 N (10 kgf) to a final load of 1,275 N (130 kgf).

Initial Velocity

The initial velocity was measured using an initial velocity measuring apparatus of the same type as the USGA drum rotation-type initial velocity instrument approved by the R&A. The ball was temperature conditioned at 23±1° C. for at least 3 hours, then tested in a chamber at a room temperature of 23±2° C. The ball was hit using a 250-pound (113.4 kg) head (striking mass) at an impact velocity of 143.8 ft/s (43.83 m/s). One dozen balls were each hit four times. The time taken to traverse a distance of 6.28 ft (1.91 m) was measured and used to compute the initial velocity of the ball. This cycle was carried out over a period of about 15 minutes. The results are shown in Table 2.

Ball Appearance

The silver metallic texture of the ball and the 3D effect of the markings on the ball were each rated as follows by a panel of ten amateur golfers.

Good: Rated as good by seven or more golfers.

NG: Rated as good by three or fewer golfers.

Appearance of the Ball's Surface when Marred

A non-plated pitching sand wedge (P/S) was set in a swing robot, and the ball was hit once at a head speed of 40 m/s. The surface state of the ball was then rated as follows by a panel of ten amateur golfers.

Good: Rated as good by seven or more golfers.

NG: Rated as good by three or fewer golfers.

The appearance of the balls in each example are summarized below.

The golf balls in Examples 1 and 2 according to the invention were found to have both a silver metallic texture and markings that appeared three-dimensional, and thus had a high-quality feel.

The golf balls in Comparative Example 1 had a silver metallic texture, but the markings were difficult to see.

The golf balls in Comparative Example 2 had an appearance similar to that of conventional balls, and lacked a silver metallic texture.

The golf balls in Comparative Example 3 had a silver metallic texture but the markings did not appear three-dimensional, and so the balls lacked a high-quality feel.

The invention claimed is:

1. A golf ball comprising a solid core of at least one layer and a cover of at least one layer, wherein at least one of the solid core and an inner cover layer adjacent to an outer cover layer has a light-reflecting pigment-containing coating applied to a surface thereof and at least the outer cover layer is transparent or translucent and has a surface that is marked with lettering or a design, the color of at least one of the solid core and an inner cover layer adjacent to the outer cover layer has a color difference before and after application of the coating, expressed in the Lab Color System, of at most 20, wherein that the lettering or design has a three-dimensional appearance as an effect of the transparent or translucent outer cover layer and wherein the light-reflecting pigment is at least one of metal powder pigments, glass flakes, mica and pearlescent pigments.

2. The golf ball of claim 1, wherein the metal powder pigment is at least one selected from the group consisting of aluminum powder, bronze powder, stainless steel powder and nickel powder.

3. The golf ball of claim 1, wherein the light-reflecting pigment is mica or glass flake which is surface-coated with titanium oxide or iron oxide.

4. The golf ball of claim 1, wherein the light-reflecting pigment is a metal powder pigment composed of aluminum powder.

5. The golf ball of claim 1, wherein the coating applied to the surface of the solid core or the inner cover layer adjacent to the outer cover layer is a thermoset coating.

6. The golf ball of claim 1, wherein the solid core has a diameter of 38.9 to 40.3 mm and the cover has a thickness of 1.2 to 1.9 mm.

7. The golf ball of claim 1, wherein the cover has a thickness of 1.45 to 1.75 mm.

8. The golf ball of claim 1, wherein dimples are formed on the surface of the cover, and the number of the dimples is 330 to 440.

9. The golf ball of claim 1, wherein the solid core has a deflection when subjected to loading from an initial load state of 98 N (10 kgf) to a final load of 1,275 N (130 kgf) of 2.5 to 5.0 mm, and the cover has a Shore D hardness of at least 50 but not more than 70.

10. The golf ball of claim 1, wherein a two-part curing urethane coating is applied to a surface of the solid core or a surface of the inner cover layer adjacent to the outer cover layer.

11. The golf ball of claim 10, wherein the two-part curing urethane coating is composed of a polyol component having hydroxyl groups and a polyisocyanate component having isocyanate groups.

12. The golf ball of claim 11, wherein the polyols include at least one selected from a group consisting of urethanes, polyesters and acrylic resins, and epoxy resins, and the polyisocyanates include at least one selected from a group consisting of tolylene diisocyanate (TDI), diphenylmethane-4,4'-diisocyanate (MDI), hexamethylene diisocyanate (HDI), isophorone diisocyanate (IPDI), naphthalene diisocyanate (NDI), 1,4-phenylene diisocyanate (PDI), xylylene diisocyanate (XDI) and hydrogenated xylylene diisocyanate (HXDI).

13. The golf ball of claim 1, wherein the light-reflecting pigment is added in an amount of 2 to 50 wt % based on the coating solids.

14. The golf ball of claim 1, wherein the applied coat of the coating has a thickness of 2 to 30 μm.

15. The golf ball of claim 1, wherein the solid core is formed primarily of polybutadiene synthesized using a rare-earth catalyst.

16. The golf ball of claim 1, wherein the solid core has a surface hardness, expressed as the Shore D hardness, of at least 46 but not more than 62, and has a center hardness, expressed as the Shore D hardness, of at least 32 but not more than 43.

17. The golf ball of claim 1, wherein the coating is a non-yellowing urethane coating.

* * * * *